US008052073B2

(12) United States Patent
Kitagawa et al.

(10) Patent No.: US 8,052,073 B2
(45) Date of Patent: Nov. 8, 2011

(54) FUEL INJECTION VALVE

(75) Inventors: Kazunori Kitagawa, Chiyoda-ku (JP); Masayuki Aota, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 129 days.

(21) Appl. No.: 12/427,315

(22) Filed: Apr. 21, 2009

(65) Prior Publication Data

US 2010/0102146 A1 Apr. 29, 2010

(30) Foreign Application Priority Data

Oct. 24, 2008 (JP) ..... 2008-274419

(51) Int. Cl.
*F02M 61/10* (2006.01)

(52) U.S. Cl. ..... 239/533.11; 239/533.12; 239/575; 239/585.1; 239/585.4; 239/DIG. 23; 210/429

(58) Field of Classification Search ..... 239/463, 239/533.3, 533.11, 533.12, 575, 584, 585.1, 239/585.4, 585.5, DIG. 23; 210/429–431, 210/499

See application file for complete search history.

(56) References Cited

U.S. PATENT DOCUMENTS

| | | | | |
|---|---|---|---|---|
| 4,453,671 | A * | 6/1984 | Hafner | 239/585.1 |
| 5,238,192 | A * | 8/1993 | McNair | 239/575 |
| 6,003,791 | A * | 12/1999 | Reiter | 239/575 |
| 6,015,103 | A * | 1/2000 | Kotkowicz | 239/585.4 |
| 7,770,812 | B2 * | 8/2010 | Sebastian | 239/DIG. 23 |
| 2007/0181713 | A1 * | 8/2007 | Mueller et al. | 239/575 |

FOREIGN PATENT DOCUMENTS

JP 2003-129922 A 5/2003

* cited by examiner

*Primary Examiner* — Steven J Ganey
(74) *Attorney, Agent, or Firm* — Sughrue Mion, PLLC

(57) ABSTRACT

A fuel injection valve includes a valve main body of a hollow tubular shape, a needle valve provided to the valve main body in a slidable manner, a valve seat opposing the needle valve to form a seat portion and having an injection hole formed downstream of the seat portion, and a guide portion provided upstream of the seat portion to guide the needle valve. An annular passage communicating in a circumferential direction is defined between the inner peripheral surface of the valve main body and the outer peripheral surface of the guide portion and a fuel passage through which to introduce a fuel from the annular passage to the seat portion is defined. An almost cylindrical filter to trap foreign matter heading toward the fuel passage is provided to the annular passage.

6 Claims, 8 Drawing Sheets

FUEL INJECTION VALVE

BACKGROUND OF THE INVENTION

1. Field of the Invention

The present invention relates to a fuel injection valve used in an internal combustion engine of an automobile or the like.

2. Background Art

For a fuel injection valve used in an internal combustion engine, besides a filter provided upstream of the fuel injection valve to prevent entrance of foreign matter from the outside, there is a technique to provide a filter inside the fuel injection value to prevent foreign matter generated inside the fuel injection valve during the fabrication process from being stuck on a seat portion (valve seat). Foreign matter stuck on the seat portion can cause fuel leakage.

In a fuel injection valve disclosed in JP-A-2003-129922, a fuel circulator causing a fuel to circulate and furnished with a capability of guiding a needle valve is disposed upstream of the seat portion and a filter is disposed on the upper end face of the fuel circulator. It thus becomes possible to trap foreign matter generated upstream of the filter.

However, in a case where the filter is disposed to the upper end face of the fuel circulator as in the related art described above, there is a problem that foreign matter like burrs coming off from an axial fuel passage inside the fuel circulator and foreign matter generated when immovably press-fitting the fuel circulator to the nozzle body (valve main body) cannot be trapped in the filter.

SUMMARY OF THE INVENTION

The invention was devised to solve the problems discussed above and has an object to obtain a fuel injection valve capable of trapping foreign matter inside the valve in a reliable manner.

A fuel injection valve according to one aspect of the invention includes a valve main body of a hollow tubular shape, a needle valve provided to the valve main body in a slidable manner, a valve seat opposing the needle valve to form a seat portion and having an injection hole formed downstream of the seat portion, and a guide portion provided upstream of the seat portion to guide the needle valve. An annular passage communicating in a circumferential direction is defined between an inner peripheral surface of the valve main body and an outer peripheral surface of the guide portion and a fuel passage through which to introduce a fuel from the annular passage to the seat portion is defined. An almost cylindrical filter to trap foreign matter heading toward the fuel passage is provided to the annular passage.

According to the fuel injection valve of the invention, by providing the filter to the annular passage communicating in the circumferential direction in a space between the valve main body of a hollow tubular shape and the guide portion that guides the needle valve, it becomes possible to trap foreign matter at a site closer to the seat portion. In addition, because there is no press-fit portion between the filter and the seat portion, it is possible to trap foreign matter generated when press-fitting a member in a reliable manner.

The foregoing and other object, features, aspects, and advantages of the present invention will become more apparent from the following detailed description of the present invention when taken in conjunction with the accompanying drawings.

DESCRIPTION OF THE PREFERRED EMBODIMENTS

First Embodiment

Figure 1:
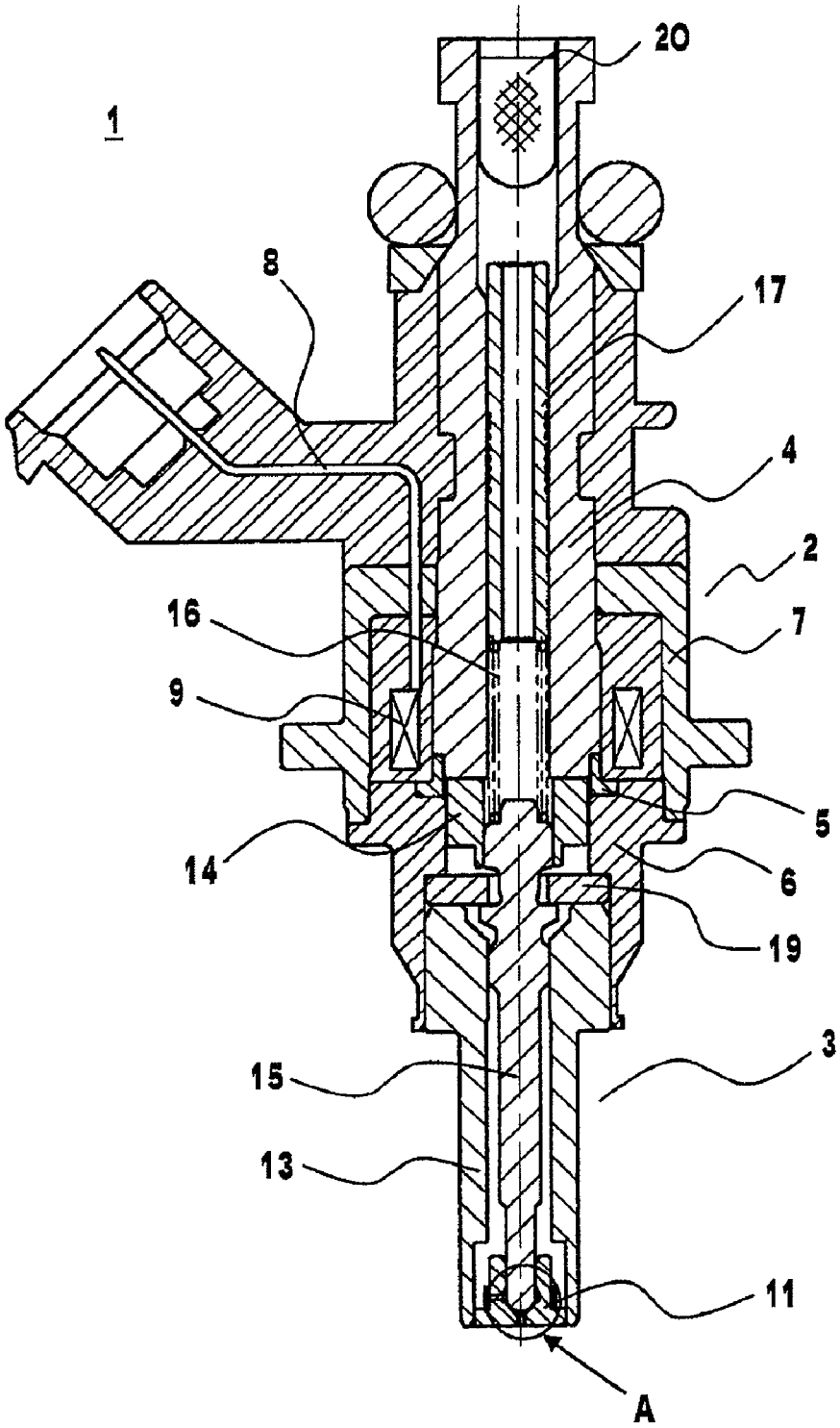
FIG. 1 is a longitudinal cross section of a fuel injection valve according to a first embodiment of the invention.
Figure 2A:
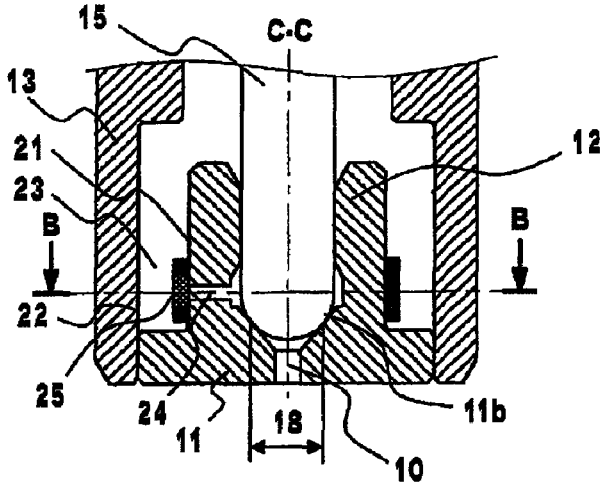
FIG. 2A is an enlarged view of a portion indicated by a letter A of FIG. 1
Figure 2B:
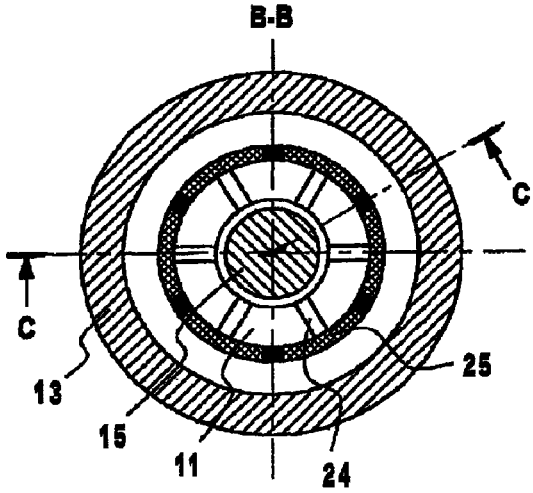
FIG. 2B is a cross section taken on line B-B of FIG. 2A.

FIG. 1 shows a fuel injection valve according to a first embodiment of the invention. FIGS. 2A and 2B are enlarged views of a portion indicated by a letter A of FIG. 1. A fuel injection valve 1 is formed of a solenoid portion 2 that generates an electromagnetic force and a valve device 3. The solenoid portion 2 forms a magnetic circuit from a core 4 as a fixed core, a ring 5 formed of a non-magnetic member, a holder 6, and a housing 7, and it accommodates a coil 9 joined to a terminal 8. The valve device 3 is formed of a valve main body 13 to which a valve seat 11 is fixed and a needle valve 15 that is a valve body having an armature 14 as a moving core. The needle valve 15 is inserted into the valve main body 13 and the valve seat 11 in a slidable manner so as to open and close.

The valve seat 11 has a guide portion 12 that guides the needle valve 15, a seat portion 11*b* that is provided downstream of the guide portion 12 and abuts on the needle valve 15 when the needle valve 15 is closed, and an injection hole 10 formed downstream of the seat portion 11*b*.

Herein, a spring 16 provided inside the core 4 is set to a specific spring force by a rod 17 and a sealing force of the seat portion 11*b* is determined by a fluid force developed by this spring force and a fuel pressure applied to the seat area according to a seat diameter 18.

In the fuel injection valve 1 configured as above, the armature 14 as a moving core is attracted to the core 4 as a fixed core when the coil 9 is excited by a valve opening signal from an unillustrated controller. The fuel injection valve 1 opens at a point in time when the attraction force exceeds the fluid force developed by the spring force and the fuel pressure. In this instance, an opening area of the seat portion 11*b* is determined by a lift amount that is regulated as the needle valve 15 abuts on a stopper 19. In order to close the fuel injection valve 1, the coil 9 is left unexcited by a valve closing signal from the controller and the fuel injection valve 1 is closed by the spring force.

Regarding a flow of a fuel, a fuel brought to a high pressure by an unillustrated fuel pump is supplied to the fuel injection valve 1 by passing through a filter 20 from an unillustrated delivery pipe. While the fuel injection valve 1 is closed, the inside of the fuel injection valve 1 is filled with a high-pressure fuel up to the needle valve 15 and to the seat portion 11*b* of the valve seat 11. The needle valve 15 is opened by a valve opening signal from the unillustrated controller and the fuel is therefore injected from the injection hole 10 formed downstream of the seat portion 11*b*.

The structure of a downstream tip end portion (a portion indicated by a letter A) of the valve device 3 will now be described in detail (see FIGS. 2A and 2B). An annular passage 23 communicating in the circumferential direction is defined between an outer peripheral surface 21 of the guide portion 12 formed integrally with the valve seat 11 and an inner peripheral surface 22 of the valve main body 13. Fuel passages 24 that open to the annular passage 23 for introducing a fuel into the seat portion 11*b* are provided. In addition, a cylindrical second filter 25 is provided so as to cover the inlet portion of each fuel passage 24. Foreign matter generated upstream of the second filter 25 is thus trapped in the second filter 25.

Figure 3A:
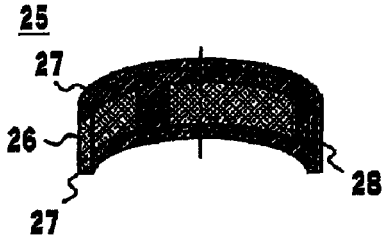
FIGS. 3A and 3B are perspective views of a halved filter of FIGS. 2A and 2B.
Figure 3B:
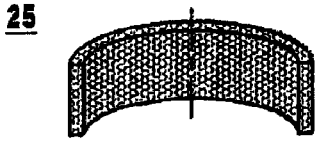

The second filter 25 will now be described in detail. FIGS. 3A and 3B are perspective views of the halved second filter 25. As is shown in FIG. 3A, the second filter 25 is of almost a cylindrical shape and formed of a filter mesh 26, frames 27 provided at the upper end and the lower end of the filter mesh 26, and ribs 28 that couple the frames 27 from top to bottom.

A material of the frames 27 is resin or metal and the minor diameter of each frame 27 is set to a dimension large enough to be press-fit to the outer peripheral surface 21 of the guide portion 12. By press-fitting the frames 27, not only can the second filter 25 be fixed to the outer peripheral surface 21 of the guide portion 12, but also a space between the frames 27 and the outer peripheral surface 21 can be sealed. It should be noted that the second filter 25 can be fixed by the frame 27 at the upper end alone.

A material of the ribs 28 is resin or metal and they are formed integrally with or separately from the frames 27. The thickness and the number of the ribs 28 can be set according to the required strength.

A material of the filter mesh 26 is resin or metal and the mesh size is set to a dimension sufficiently smaller than a clearance in the seat portion 11*b*.

In addition, as is shown in FIG. 3B, the second filter 25 may be made of porous resin or metal. In this case, because a certain degree of rigidity can be ensured, the frames 27 and the ribs 28 may be omitted.

As has been described, a fuel injection valve of the first embodiment includes: a valve main body 13 of a hollow tubular shape, a needle valve 15 provided to the valve main body 13 in a slidable manner, a valve seat 11 opposing the needle valve 15 to form a seat portion 11*b* and having an injection hole 10 formed downstream of the seat portion 11*b*, and a guide portion 12 provided upstream of the seat portion 11*b* to guide the needle valve 15. An annular passage 23 communicating in a circumferential direction is defined between an inner peripheral surface 22 of the valve main body 13 and an outer peripheral surface 21 of the guide portion 12 and a fuel passage 24 through which to introduce a fuel from the annular passage 23 to the seat portion 11*b* is defined. Also, a filter 25 of almost a cylindrical shape to trap foreign matter heading toward the fuel passage 24 is provided to the annular passage 23. It thus becomes possible to trap foreign matter generated upstream of the fuel passage 24 and to prevent entrance of foreign matter into the fuel passage 24 due to press-fitting in a reliable manner because there is no member to be press-fit in a space between the filter 25 and the seat portion 11*b*.

Second Embodiment

Figure 4A:
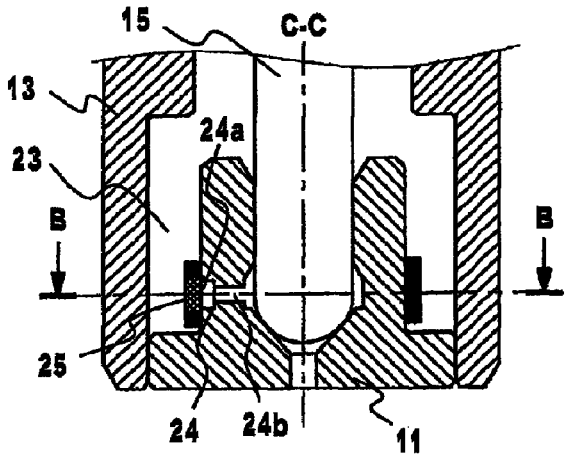
FIG. 4A is a cross section of a major portion of a fuel injection valve according to a second embodiment of the invention and FIGS. 4B and 4C are cross section taken on line B-B of FIG. 4A.
Figure 4B:
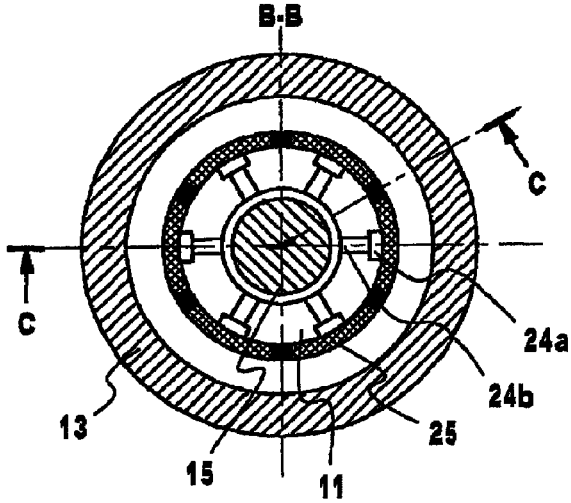
Figure 4C:
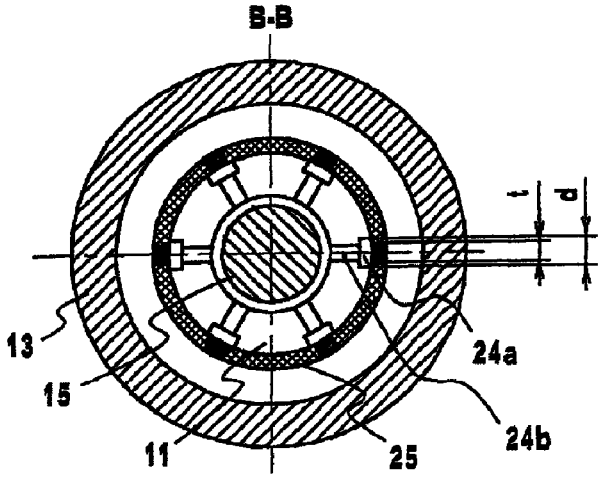

FIGS. 4A through 4C show a second embodiment of the invention. In a case where the filter mesh 26 is present near the inlet surfaces of the fuel passages 24, the filter mesh 26 reduces the passage area of fuel passages 24, which can give rise to a pressure loss at the inlet portions of the fuel passages 24. According to the second embodiment, by setting the passage area at an inlet portion 24*a* of each fuel passage 24 to be larger than the passage area at an outlet portion 24*b*, it is possible to set the passage area at the inlet portion 24*a* to be larger than the passage area at the outlet portion 24*b* even when the filter mesh 26 is present near the inlet portion 24*a* of the fuel passage 24. No pressure loss is thus produced in the passage at the inlet portion 24*a*. In addition, the positions of the fuel passages 24 and the ribs 28 may overlap depending on the circumferential position of the second filter 25. In this instance, because the ribs 28 clog the passages at the inlet portions 24*a* of the fuel passages 24, the passage area at the inlet portions 24*a* may possibly be made smaller than the passage area at the outlet portions 24*b*. However, as is shown in FIG. 4C, by setting a passage width d at the inlet portion 24*a* to be larger than a rib width t, it is possible to set the passage area at the inlet portions 24*a* to be larger than the passage area at the outlet portions 24*b*.

Figure 5:
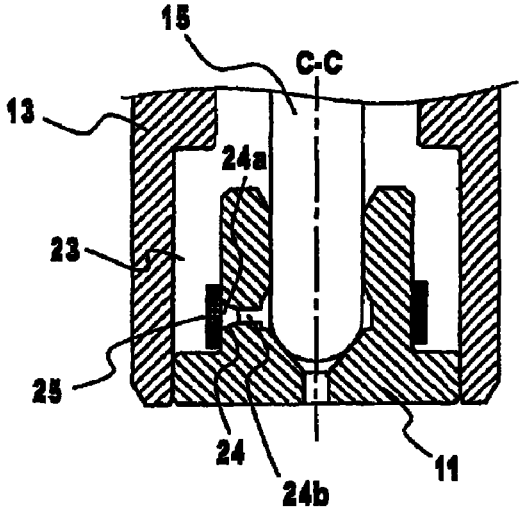
FIG. 5 is a cross section of a major portion of the fuel injection valve according to another example of the second embodiment.

Alternatively, as is shown in FIG. 5, the fuel passage 24 may be tapered from the inlet portion 24*a* to the outlet portion 24*b*.

Third Embodiment

Figure 6A:
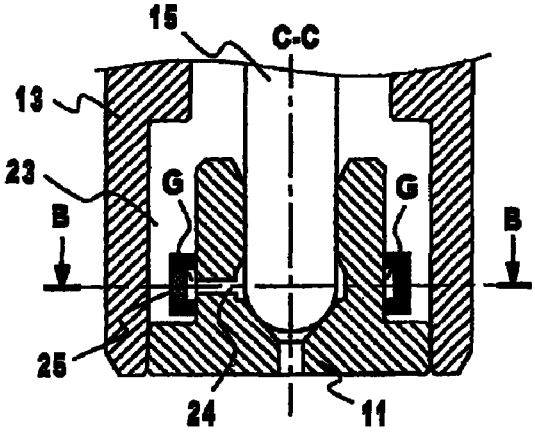
FIG. 6A is a cross section of a major portion of a fuel injection valve according to a third embodiment of the invention and FIG. 6B is a cross section taken on line B-B of FIG. 6A.
Figure 6B:
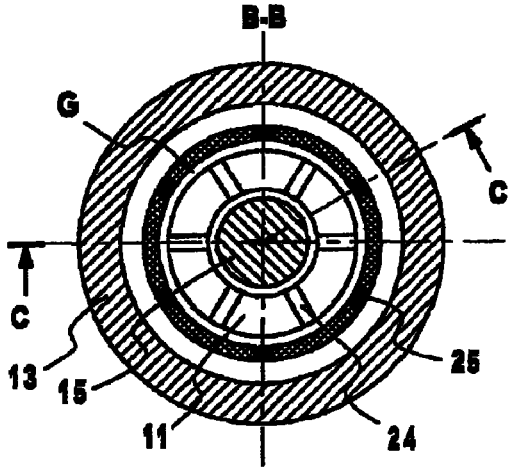
Figure 7:
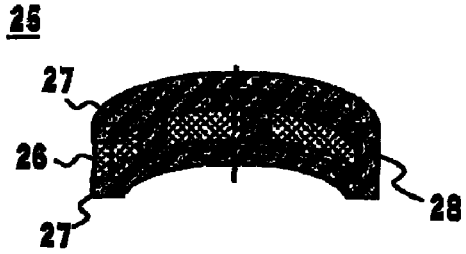
FIG. 7 is a perspective view of a halved filter of FIGS. 6A and 6B.

FIGS. 6A and 6B and FIG. 7 show a third embodiment of the invention. FIG. 7 is a perspective view of the halved second filter 25. According to the third embodiment, the filter mesh 26 of the second filter 25 is provided to the frames 27 near on the major diameter side. The second filter 25 is therefore fixed by the press-fitting of the minor diameters of the frames 27 and the outer peripheral surface 21 of the guide portion 12.

It thus becomes possible to ensure a clearance G between the outer peripheral surface 21 and the filter mesh 26, which can in turn prevent the passage area at the inlet portions 24*a* of the fuel passages 24 from being reduced by the filter mesh 26.

In addition, because the clearance G is present all along between the filter mesh 26 and the outer peripheral surface 21, the passages at the inlet portions 24*a* of the fuel passages 24 will not be clogged by the filter mesh 26 independently of the circumferential position of the second filter 25.

Figure 8A:
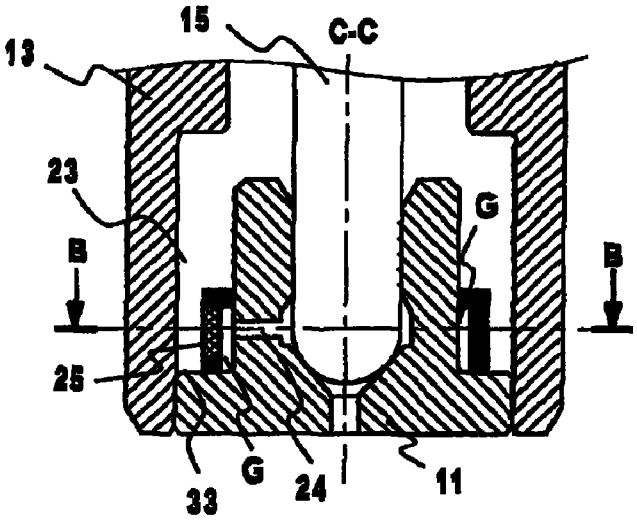
FIG. 8A is a cross section of a major portion of the fuel injection valve according to another example of the third embodiment and FIG. 8B is a cross section taken on line B-B of FIG. 8A.
Figure 8B:
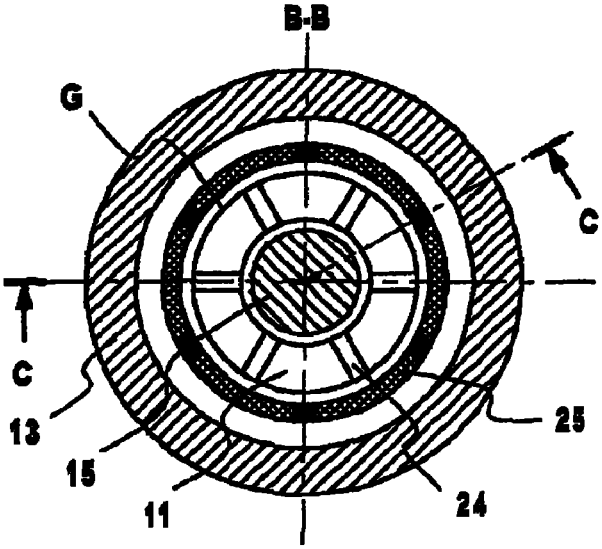
Figure 9:
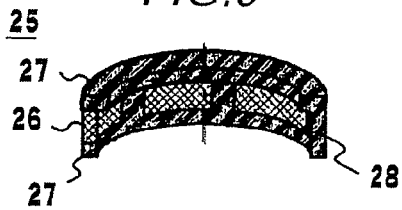
FIG. 9 is a perspective view of a halved filter of FIGS. 8A and 8B.

Alternatively, as are shown in FIGS. 8A and 8B, the upper end of the second filter 25 may be formed in the same manner as are shown in FIGS. 6A and 6B whereas the frame 27 at the lower end may be provided so as to abut on an upper end face 33 of the valve seat 11. FIG. 9 is a perspective view of the halved second fitter 25 in this case.

Fourth Embodiment

Figure 10A:
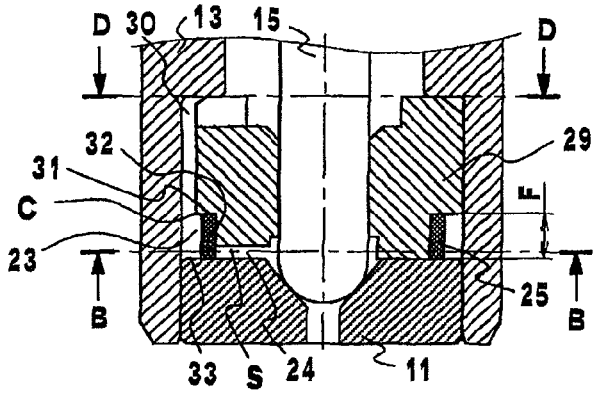
FIG. 10A is a cross section of a major portion of a fuel injection valve according to a fourth embodiment of the invention.
Figure 10B:
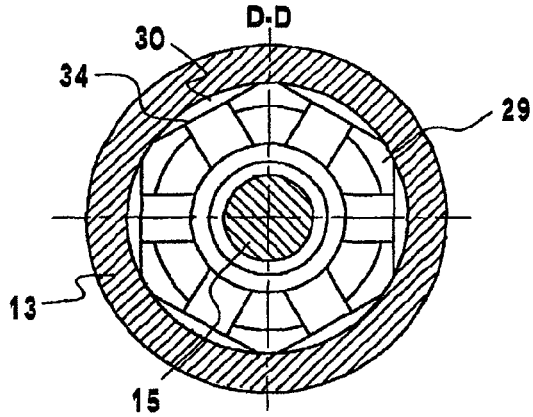
FIG. 10B is a cross section taken on line D-D of FIG. 10A.
Figure 10C:
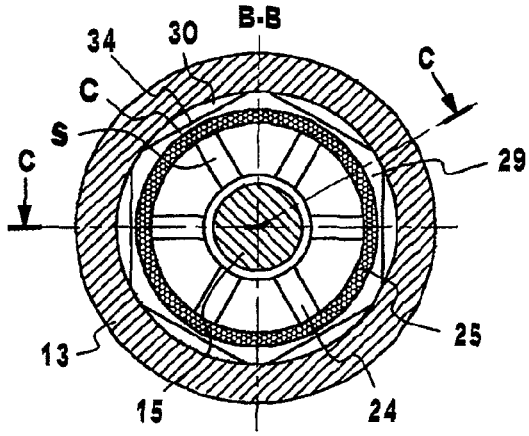
FIG. 10C is a cross section taken on line B-B of FIG. 10A.
Figure 11:
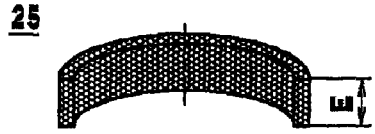
FIG. 11 is a perspective view of a halved filter of FIGS. 10A through 10C.
Figure 12A:
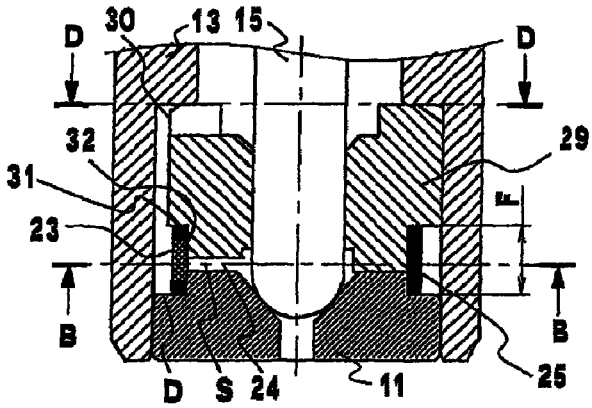
FIG. 12A is a cross section of a major portion of a fuel injection valve according to a fifth embodiment of the invention.
Figure 12B:
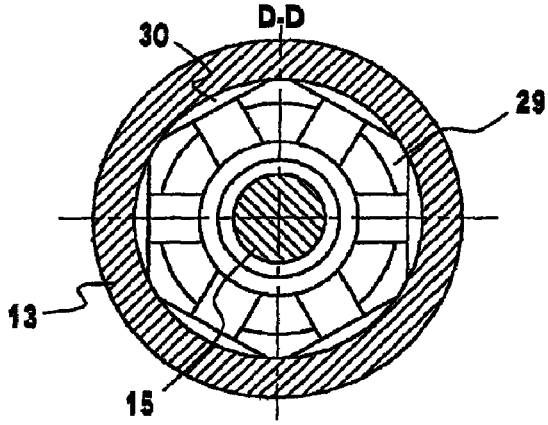
FIG. 12B is a cross section taken on line D-D of FIG. 12A.
Figure 12C:
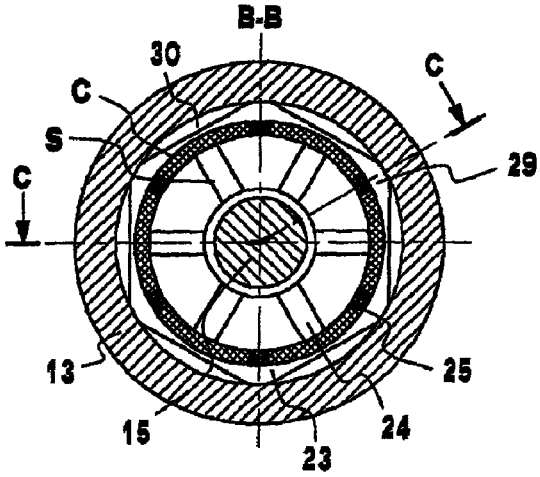
FIG. 12C is a cross sections taken on line B-B of FIG. 12A.

FIGS. 10A through 10C and FIG. 11 show a fourth embodiment of the invention. FIG. 11 is a perspective view of the halved second filter 25. According to the fourth embodiment, the guide portion 12 is provided to a guide member 29 formed separately from the valve seat 11. The lower end face of the guide member 29 is in contact with the upper end face of the valve seat 11 and defines the fuel passages 24 by grooves S provided to the lower end face of the guide member 29 and the upper end face of the valve seat 11. The outer periphery of the guide member 29 is immovably press-fit to the inner peripheral surface 22 of the valve main body 13 and it forms flat surface portions 34 in part. The flat surface portions 34 and the inner peripheral surface 22 of the valve main body 13 define axial fuel passages 30 in the outer peripheral portion of the guide member 29.

Further, the guide member 29 has a concave portion C in the outer peripheral lower end portion on the peripheral side one step inner from the axial fuel passages 30. An upper end face 31 and an outer peripheral surface 32 of the concave portion C and the upper end face 33 of the valve seat 11 define an annular passage 23 almost in the shape of a letter U when viewed in a cross section. By providing the second filter 25 in the annular passage 23, it is possible to prevent the second filter 25 from falling off.

The second filter 25 is formed of a porous member made of resin or metal. By setting a height dimension E of the second filter 25 to be larger than a distance (annular passage height) F between the upper end face (the upper end face 31 of the concave portion C) and the lower end face (the upper end face 33 of the valve seat 11) of the annular passage 23, it becomes possible to fix the filter 25 in a compressed state. Clearances between the second filter 25 and the upper end face and the lower end face of the annular passage 23 can be therefore sealed. In this case, the dimension of the second filter 25 can be set more roughly than in a case where the second filter 25 is immovably press-fit to the outer peripheral portion of the guide member 29.

As has been described, a fuel injection valve of the fourth embodiment includes a valve main body 13 of a hollow tubular shape, a needle valve 15 provided to the valve main body 13 in a slidable manner, a guide member 29 configured to guide the needle valve 15, and a valve seat 11 provided downstream of the guide member 29 and having a seat portion 11*b* configured to abut on the needle valve 15 when the needle valve 15 is closed and an injection hole 10 formed downstream of the seat portion 11*b*. An annular passage 23 communicating in a circumferential direction is defined between an inner peripheral surface 22 of the valve main body 13 and an outer peripheral surface of the guide member 29 and a fuel passage 24 through which to introduce a fuel from the annular passage 23 to the seat portion 11*b* is defined. A filter 25 of almost a cylindrical shape to trap foreign matter heading toward the fuel passage 24 is provided to the annular passage 23. It thus becomes possible to trap foreign matter generated upstream of the fuel passage 24 and to prevent entrance of foreign matter into the fuel passage 24 due to press-fitting in a reliable manner because there is no member to be press-fit in a space between the filter 25 and the seat portion 11*b*.

Fifth Embodiment

Figure 13:
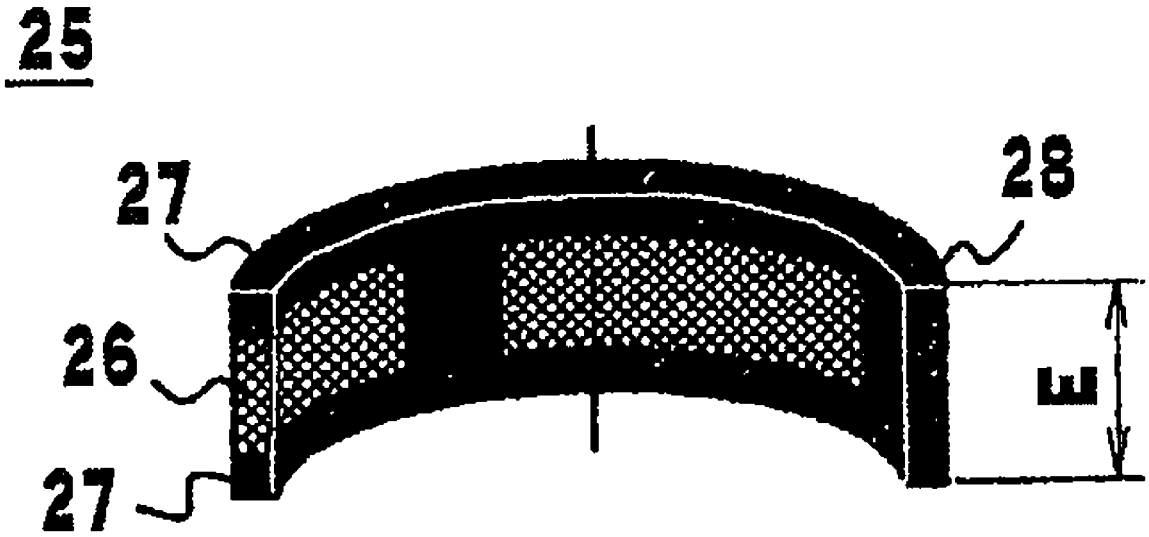
FIG. 13 is a perspective view of a halved filter of FIGS. 12A through 12C.

FIGS. 12A through 12C and FIG. 13 show a fifth embodiment of the invention. As is shown in FIG. 13, the second filter 25 is formed of the frames 27 and the ribs 28 in the same manner as in the first embodiment above. In this case, a step D is provided to the upper end face of the valve seat 11 so that the lower frame 27 will not interfere with the fuel passages 24. The lower frame 27 is thus provided to a portion where it is lowered by one step.

As in the same manner shown in FIGS. 10A through 10C, by setting the full length E of the second filter 25 to be larger than the annular passage height F, the second filter 25 can be assembled in a state compressed in the axial direction, which makes it possible to seal spaces between the frames 27 and the upper and lower end faces of the annular passage 23. The second filter 25 can be therefore assembled with the dimension set more roughly than in a case where the frames 27 are assembled in a press-fit state.

The grooves S that define the fuel passages 24 may be provided on the side of the valve seat 11.

It should be appreciated that it is possible to adopt the configurations of the second embodiment above, such as making the passage area at the inlet portions 24*a* of the fuel passages 24 to be larger than the passage area at outlet portions 24*b* and tapering the fuel passages 24 from the inlet portions 24*a* to the outlet portions 24*b*, in the fourth and fifth embodiments, too.

In addition, the filter 25 may be formed of a filter mesh, frames, and ribs in the same manner as in the third embodiment above, so that the clearance G is defined all along between the filter 25 and the outer peripheral surfaces at the inlet portions 24*a* of the fuel passages 24.

Various modifications and alterations of this invention will be apparent to those skilled in the art without departing from the scope and spirit of this invention, and it should be understood that this is not limited to the illustrative embodiments set forth herein.

What is claimed is:

1. A fuel injection valve, comprising:

a valve main body of a hollow tubular shape;

a needle valve provided to the valve main body in a slidable manner; and a valve seat having a guide portion configured to guide the needle valve, a seat portion provided downstream of the guide portion and configured to abut on the needle valve when the needle valve is closed, and an injection hole formed downstream of the seat portion, wherein:

an annular passage communicating in a circumferential direction is defined between an inner peripheral surface of the valve main body and an outer peripheral surface of the guide portion and a fuel passage through which to introduce a fuel from the annular passage to the seat portion is defined; and a filter of almost a cylindrical shape to trap foreign matter heading toward the fuel passage is provided to the annular passage, wherein:

the entire filter is made of one of porous resin and porous metal and a minor diameter thereof is set to a size large enough to be press-fit to the outer peripheral surface of the guide portion.

2. The fuel injection valve according to claim 1, wherein:

a passage area at an inlet portion of the fuel passage is larger than a passage area at an outlet portion.

3. The fuel injection valve according to claim 1, wherein:

the fuel passage is tapered from the inlet portion to the outlet portion.

4. A fuel injection valve, comprising:

a valve main body of a hollow tubular shape;

a needle valve provided to the valve main body in a slidable manner;

a guide member configured to guide the needle valve; and a valve seat provided downstream of the guide member and having a seat portion configured to abut on the needle valve when the needle valve is closed and an injection hole formed downstream of the seat portion;

wherein:

an annular passage communicating in a circumferential direction is defined between an inner peripheral surface of the valve main body and an outer peripheral surface of the guide member and a fuel passage through which to introduce a fuel from the annular passage to the seat portion is defined;

a filter of almost a cylindrical shape to trap foreign matter heading toward the fuel passage is provided to the annular passage; and the entire filter is made of one of porous resin and porous metal and a minor diameter thereof is set to a size large enough to be press-fit to the outer peripheral surface of the guide member.

5. The fuel injection valve according to claim 4, wherein:

a passage area at an inlet portion of the fuel passage is larger than a passage area at an outlet portion.

6. The fuel injection valve according claim 4, wherein:

the fuel passage is tapered from the inlet portion to the outlet portion.

* * * * *